US006210209B1

(12) United States Patent
Wu et al.

(10) Patent No.: US 6,210,209 B1
(45) Date of Patent: Apr. 3, 2001

(54) ELECTRICAL CONNECTOR FOR FPC

(75) Inventors: Ming Chuan Wu, Shun-Lin; Guan Fu Huang, Tu-Chen, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/451,201

(22) Filed: Nov. 29, 1999

(30) Foreign Application Priority Data

Oct. 1, 1999 (TW) ..... 88216645

(51) Int. Cl.[7] ..... H01R 12/28
(52) U.S. Cl. ..... 439/495
(58) Field of Search ..... 439/260, 495, 439/74, 67, 77

(56) References Cited

U.S. PATENT DOCUMENTS 5,458,506 * 10/1995 Yamaguchi et al. ..... 439/495
5,525,072 * 6/1996 Kunishi ..... 439/495
5,906,504 * 5/1999 Igarashi et al. ..... 439/495
5,921,785 * 7/1999 Ii ..... 439/495
5,928,027 * 7/1999 Kunishi ..... 439/495
5,928,029 * 7/1999 Lam ..... 439/495

* cited by examiner

*Primary Examiner*—Gary F. Paumen
(74) *Attorney, Agent, or Firm*—Wei Te Chung

(57) ABSTRACT

An electrical connector for connecting a flexible printed circuit (FPC) to a board-mounted connector comprises a dielectric housing, a plurality of generally U-shaped electrical contacts accommodated in the housing and a stuffer mountable to the housing. The housing has a plug portion at one end defining a central portion therein and a receptacle portion at an opposite end defining an elongated channel therein. The contacts laterally straddle the central portion of the plug portion to connect with terminals of the board-mounted connector and are reliably retained by a contact retention structure defined in the central portion. Each contact comprises a curved contacting finger extending into the elongated channel of the receptacle portion. The stuffer is partially inserted into the channel of the receptacle portion to press the FPC against the curved contacting fingers of the contacts situated close to an inner wall of the channel.

1 Claim, 4 Drawing Sheets

ELECTRICAL CONNECTOR FOR FPC

BACKGROUND OF THE INVENTION

1. Field of the Invention

The present invention relates to an electrical connector and particularly to an electrical connector for connecting a flexible printed circuit board (FPC) with a complementary connector and in turn to a circuit board.

2. Description of the Prior Art

Electrical connectors are normally used to aid in connecting a FPC to a conventional circuit board. One example of the related art is disclosed in U.S. Pat. No. 5,458,506. As is shown in FIG. 4, a conventional connector for a FPC comprises an insulative housing 5, a plurality of electrical terminals 6 mounted in the housing 5, and a rotatable cover plate 7 mounted at a fulcrum portion 8 of the terminal 6 facing an open space above the terminals 6. While the cover plate 7 is in the open position as shown in phantom in FIG. 4, the FPC 9 is inserted into a cavity 10 of the housing 5 between the terminals 6 and the cover plate 7 at a zero insertion force. Then the cover plate 7 is turned clockwise around the fulcrum portion 8 through an angle of nearly 90° to a closed position and a pressure edge 71 at the lower surface thereof directly presses the FPC 9 to the electrical terminals 6.

The FPC 9 can be electrically connected with the connector in the way described above, but the pressure exerted on the FPC 9 by the cover plate 7 is applied to the terminals 6 directly. The terminals 6 may be permanently deformed by use, resulting in decreased resilience and an increase in the gap between the terminals 6 and the cover plate 7 which in turn can result in unstable signal transmission and unstable retention of the FPC 9 in the housing 5. Furthermore, the cover plate 7 is loose when in an open position and can readily cause deformation or damage to the housing 5 if acted upon by an unintentional external force or vibration. Lastly the connector occupies a relative large area of precious space in a computer, which runs counter to the present trend toward miniaturization and integration of computer elements.

SUMMARY OF THE INVENTION

The main object of the present invention is to provide an electrical connector for connecting a FPC with a board-mounted connector such as a board to board connector and resolving the above mentioned problems of the prior art.

An electrical connector in accordance with the present invention comprises a dielectric housing, a plurality of generally U-shaped electrical contacts disposed in the housing, and a stuffer mountable to the housing.

The dielectric housing defines a receptacle portion on one side for receiving a FPC and a plug portion on an opposite side for mating with the board-mounted connector. The receptacle portion of the housing defines an elongated channel and the plug portion has a pair of grooves and a central portion separating the two grooves. The central portion of the plug portion defines a contact retention structure comprising a plurality of passages in opposite sides thereof and a plurality of supporting posts separating opposite passages. The plug portion of the housing has a pair of engaging members projecting from lateral end walls thereof.

Each U-shaped contact laterally straddles one of the supporting posts and is retained by the contact retention structure of the central portion to positively engage with a corresponding terminal of the board-mounted connector. Each contact comprises a curved contacting finger extending into the elongated channel of the receptacle portion.

The stuffer comprises a pressing portion and an engaging portion depending from and perpendicular to the pressing portion. The engaging portion has a main body and a pair of arms relatively longer than the main body to adjustably engage with the engaging member of the housing thereby adjusting the relative position of the stuffer and the housing. The main body of the engaging portion presses the FPC, which is inserted between the main body and a mating wall of the elongated channel, against the curved contacting fingers of the electrical contacts situated close to the mating wall. The distal edge of the main body of the engaging portion and the bottom corner of the channel of the housing form ramps complementary with each other.

Other objects, advantages and novel features of the invention will become more apparent from the following detailed description of the present embodiment when taken in conjunction with the accompanying drawings.

DETAILED DESCRIPTION OF THE INVENTION

Figure 1:
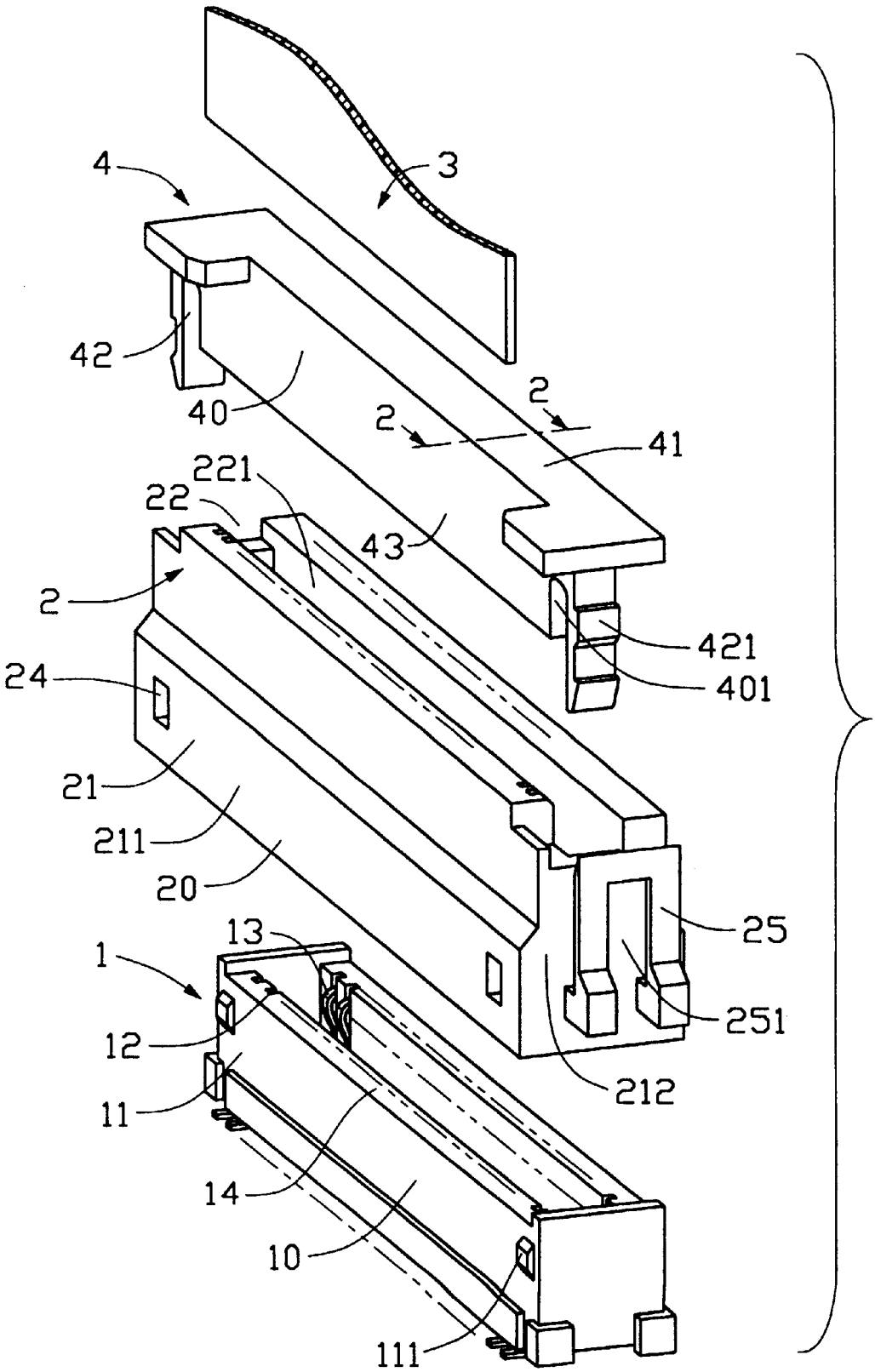
FIG. 1 is an exploded view of an electrical connector assembly of the present invention.
Figure 2:
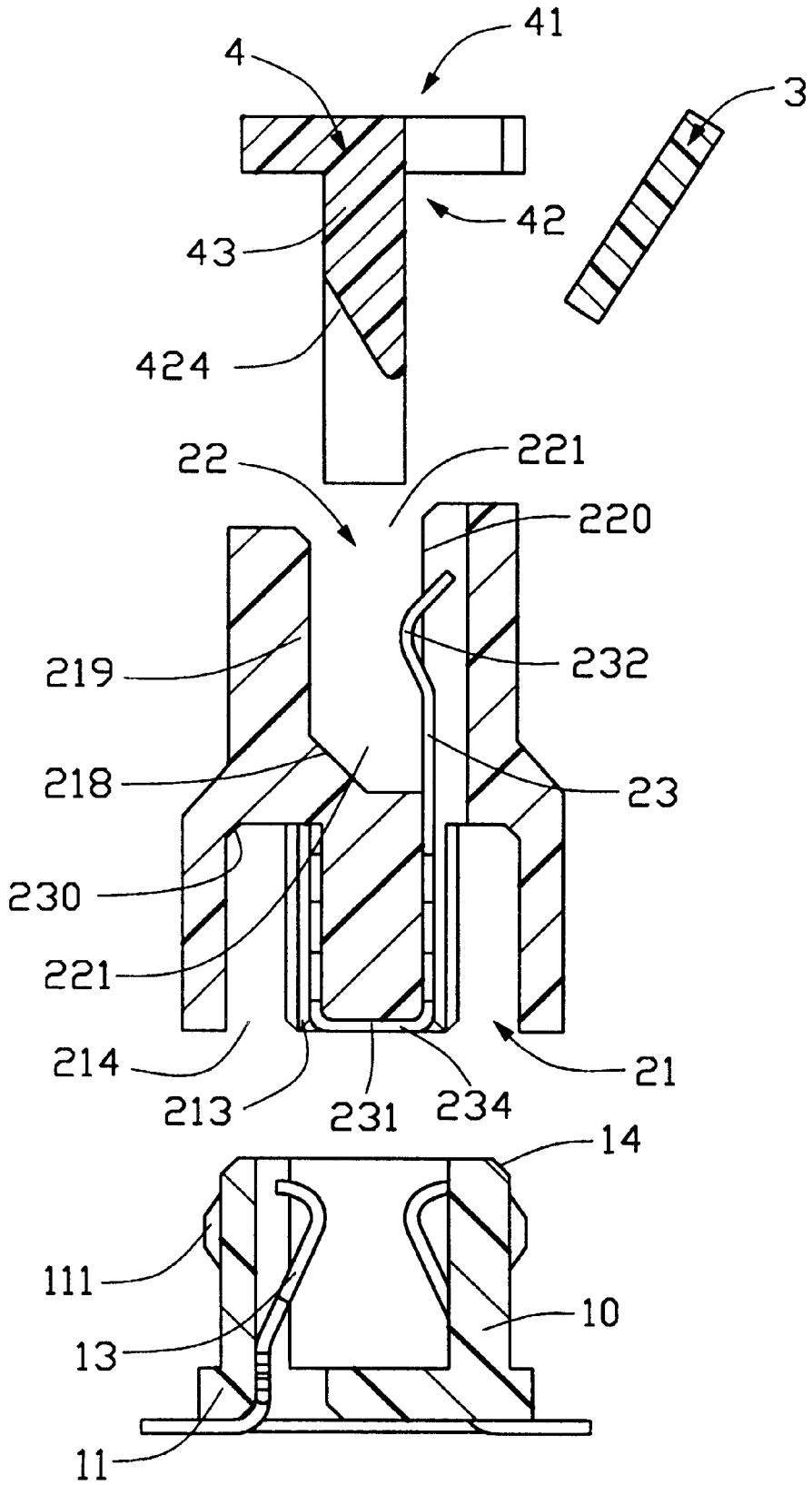
FIG. 2 is a sectional view taken from line 2—2 of FIG. 1.
Figure 3:
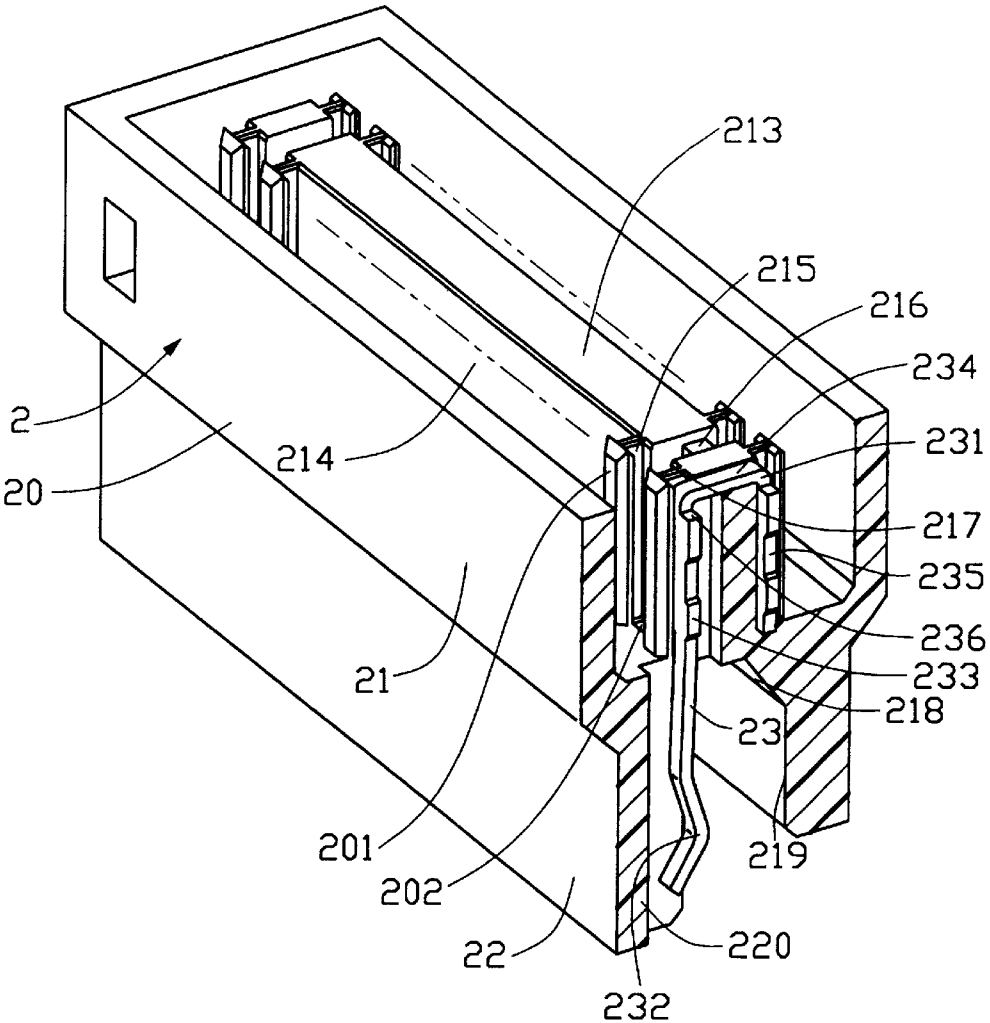
FIG. 3 is a perspective sectional view of an electrical connector of the present invention.
Figure 4:
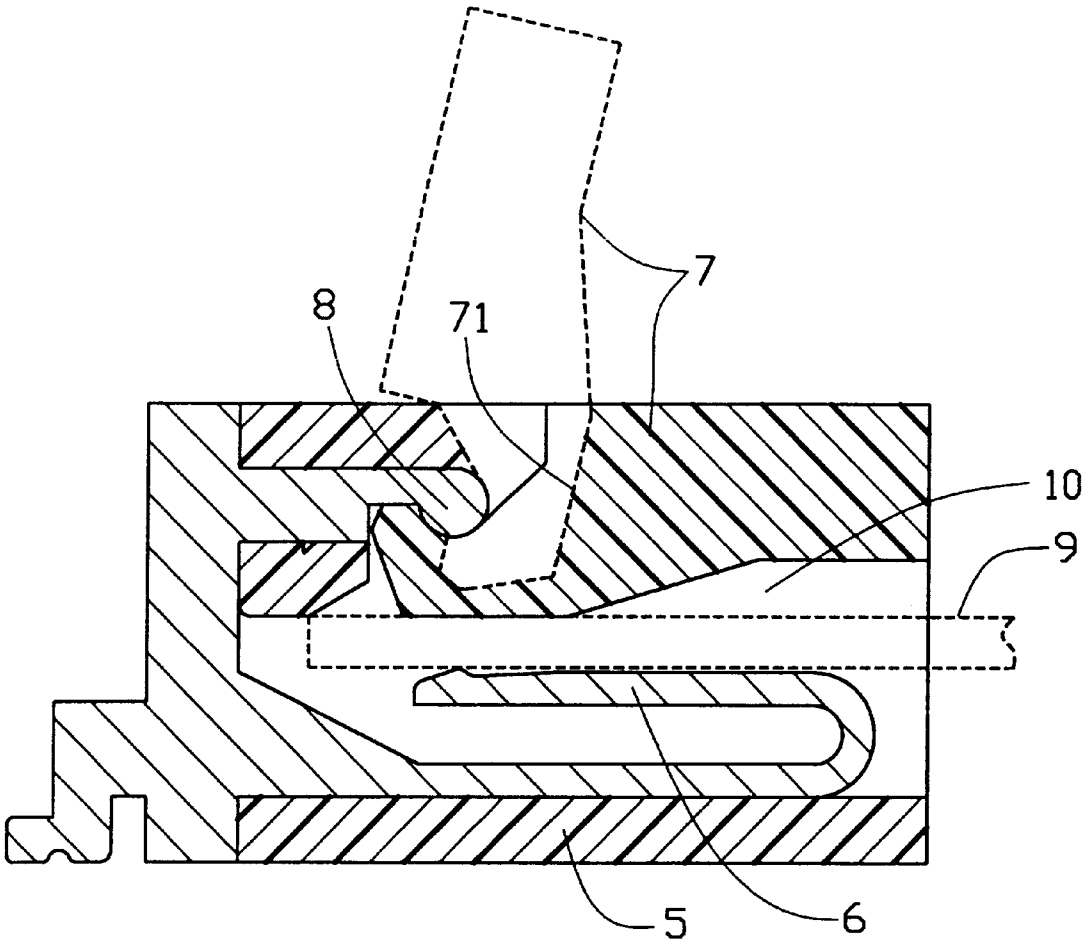
FIG. 4 (PRIOR ART)
FIG. 4 is a sectional view of a conventional connector with its cover engaging portion turned to the closed position.

Referring to FIGS. 1 to 3, an electrical connector 2 according to the present invention is designed for connecting a flexible printed circuit board (FPC) 3 to a board-mounted connector 1.

The electrical connector 2 includes a dielectric housing 20, a plurality of generally U-shaped contacts 23 mounted in the insulative housing 20, and a stuffer 4 insertable into the housing 20.

The housing 20 comprises a plug portion 21 at a lower end thereof and a receptacle portion 22 at an upper end thereof, which is not as wide as the plug portion 21.

The plug portion 21 includes two lateral end walls 212 having a pair of engaging members 25 projecting therefrom and defining a cutout 251 in a center portion thereof, and two longitudinal side walls 211 defining two pairs of apertures 24 at opposite ends thereof. The plug portion 21 has a central portion 213 and a pair of grooves 214 between the central portion 213 and the longitudinal side walls 211 thereof. The central portion 213 defines a contact retention structure comprising a plurality of passages 215 defined in opposite longitudinal sides thereof and a plurality of supporting posts 216 separating the passages 215 in the opposite sides thereof. Neighboring passages 215 in the same side share a bottom portion 217 and an outer side portion 201. Each supporting post 216 is substantially shorter than a bottom of the central portion 213. The grooves 214 each define a mating ramped face 230 at an outer corner thereof (see FIG. 2).

The receptacle portion 22 defines an elongated channel 221 therein and the channel 221 defines a mounting surface 219 and an opposite mating surface 220. An inclined surface 218 is formed between the mounting surface 219 and a bottom surface (unlabelled) of the channel 221. A plurality of through holes 202 (see FIG. 3) in communication with one groove 214 of the plug portion are defined in the bottom surface (unlabelled) of the channel 221.

The contacts 23 each comprise a U-shaped portion 231 and a curved contacting finger 232. The U-shaped portion 231 includes a pair of retaining portions 235 and an intermediate portion 234 connecting the retaining portions 235. A pair of barbs 233 is formed on either side of each retaining portion 235. Another inventive feature of the present invention is that its unique U-shaped contacts 23 are fabricated so that the connection between each contact 23 and its carrier strip is at a V-shaped cut on the particular surface denoted by 236 in FIG. 3, which is on the rear face of a barb 233.

The stuffer 4 comprises a pressing portion 41 including an opening (unlabelled) on one edge thereof and an engaging portion 40 depending from and perpendicular to the pressing portion 41. The engaging portion 40 comprises a main body 43 and a pair of arms 42. The arms 42 are relatively longer than the main body 43 and each comprises a pair of stepped blocks 421 thereon. Two gaps 401 are defined between lower sections of the main body 43 and the arms 42. The main body 43 of the engaging portion 40 defines a ramped edge 424 at a lower edge thereof.

The board-mounted connector 1 comprises an insulative housing 11 and a plurality of electrical terminals 13. The housing 11 forms two longitudinal side walls 10 each defining a plurality of passageways 12 therein, the plurality of terminals 13 being accommodated in the passageways 12. Each side wall 10 forms a pair of tabs 111 at opposite ends thereof and defines a sloping surface 14 at a top end thereof.

In assembly, the retaining portions 235 of the contacts 23 interferentially fit into the corresponding passages 215 and are confined by the outer side portions 201 of the passages 215. The curved contacting fingers 232 of the contacts 23 extend through corresponding through holes 202 into the channel 221 of the receptacle portion 22 and are situated close to the mating surface 220 of the channel 221. The U-shaped portions 231 of the contacts 23 laterally straddle the associated supporting posts 216 of the central portion 213 of the plug portion 21. The arms 42 of the stuffer 4 are inserted between the lateral end walls 212 and the engaging member 25, the stepped blocks 421 of the arms 42 adjustably engaging with the cutouts 251 and the engaging portion 40 partially entering into the channel 221. The longitudinal side walls 10 of the board-mounted connector 1 are inserted into the grooves 214 of the plug portion 21 of the connector 2. Each terminal 13 in corresponding passageway 12 of the board-mounted connector 1 engages with one retaining portion 235 of each contact 23 at one end thereof and is mounted to a circuit board (not shown) at the other end thereof. The mating ramped faces 230 of the grooves 214 of the plug portion 21 mate with the sloping surfaces 14 of the board-mounted connector 1 and the tabs 111 lock with the apertures 24, thereby providing a reliable retention between the connectors 1 and 2.

In use, the FPC 3 is inserted through the opening (unlabelled) of the pressing portion 41 into the channel 221. A user presses downward on the pressing portion 41 and the ramped edge 424 of the engaging portion 40 cooperates with the inclined surface 218 to move the main body 43 to press the FPC 3 against the curved contact fingers 232 of the contacts 23 while the gaps 401 receive the lateral end walls 212 and the stepped blocks 421 engage with the cutouts 251 for adjusting the engaging force between the FPC 3 and the curved contacting finger 232.

The contacts 23 are reliably retained by the contact retention structure of the central portion 213 of the plug portion 21. The force applied by the stuffer 4 to the FPC 3 is transferred by the contacts 23 to the mating surface 220, so the contacts 23 are not deformed even after a long-term period and maintain their resiliency. While not in operation, the stuffer 4 is fixed in the connector 2 by adjustably engaging the arms 42 and the engaging member 25, thereby avoiding damage to the housing 20 by the stuffer 4.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric housing including a plug portion and an opposite receptacle portion, the plug portion having a central portion and a pair of grooves between the central portion and opposite longitudinal side walls thereof, the receptacle portion defining an elongated channel, the central portion of the plug portion defining a contact retention structure therein;

a plurality of generally U-shaped contacts laterally straddling the central portion of the plug portion and being retained by the contact retention structure of the central portion, each contact having a contacting finger extending into the channel of the receptacle portion; and a stuffer latched to the insulative housing, the stuffer including a pressing portion and an engaging portion depending from the pressing portion and inserted into the channel of the receptacle portion to press a flexible printed circuit against the contacting fingers of the contacts;

wherein the retention structure of the central portion comprises a plurality of passages in opposite longitudinal sides thereof and a plurality of supporting posts along a length thereof, neighboring passages in a same side sharing one bottom portion and one outer side portion thereof;

wherein each contact comprises a U-shaped portion and the contacting finger, and the U-shaped portion comprises a pair of retaining portions and an intermediate portion connecting the retaining portions, the intermediate portion being supported by a corresponding supporting post and being flush with a bottom of the central portion;

wherein each of the retaining portions of the contacts forms a plurality of barbs on either side thereof to engage with the associated bottom portions of a passage and each retaining portion is confined by the outer side portions of the associated passage;

wherein each of the contacting fingers forms a curved portion at a distal end thereof and the channel of the receptacle portion defines a mating wall at a longitudinal inner surface thereof, the contacting fingers being situated close to the mating wall;

wherein the engaging portion of the stuffer comprises a main body and a pair of arms each defining a plurality of stepped blocks thereon, and the plug portion forms two engaging members projecting from lateral sides thereof and each having a cutout to latch with the stepped blocks of the arms;

wherein a pair of gaps is defined between lower sections of the arms and the main body of the engaging portion to engage with opposite lateral end walls of the receptacle portion;

wherein the pressing portion of the stuffer has an opening on one edge thereof, wherein the plug portion of the housing defines a pair of apertures at opposite ends of each longitudinal side thereof.

* * * * *